US005079497A

United States Patent [19]

Barbu et al.

[11] Patent Number: 5,079,497

[45] Date of Patent: Jan. 7, 1992

[54] CIRCUIT INTENDED TO SUPPLY A REFERENCE VOLTAGE

[75] Inventors: Stéphane Barbu; Richard Morisson; Philippe Gandy, all of Caen, France

[73] Assignee: U.S. Philips Corporation, New York, N.Y.

[21] Appl. No.: 567,415

[22] Filed: Aug. 14, 1990

[30] Foreign Application Priority Data

Aug. 22, 1989 [FR] France ..... 89 11114

[51] Int. Cl.[5] ..... G05F 1/44

[52] U.S. Cl. ..... 323/281; 323/901; 323/274; 323/303; 363/49

[58] Field of Search ..... 323/273, 901, 281, 280, 323/275, 274, 303; 363/49

[56] References Cited

U.S. PATENT DOCUMENTS

| | | | |
|---|---|---|---|
| 3,743,923 | 7/1973 | Steudel | 323/281 |
| 4,368,420 | 1/1983 | Kuo | 323/303 |
| 4,400,661 | 8/1983 | Duley | 323/275 |

FOREIGN PATENT DOCUMENTS

| | | | |
|---|---|---|---|
| 0043643 | 3/1980 | Japan | 323/281 |
| 0099510 | 6/1984 | Japan | 323/281 |

*Primary Examiner*—Steven L. Stephan
*Assistant Examiner*—Ben Davidson
*Attorney, Agent, or Firm*—Michael E. Marion

[57] ABSTRACT

The invention relates to a circuit intended to supply a reference voltage comprising a voltage generator (REF) provided with a supply terminal and an output for supplying a voltage having a given nominal value ($V_R$) and comprising a differential amplifier (A), fed by a first supply voltage, whose non-inverting input is connected to the output of the voltage generator (REF). An output of the differential amplifier (A) is connected to an input of a follower stage (T) through a controlled switching device (1), the follower stage (T) having its input connected to the first supply voltage through a first resistor ($R_1$) and having its output, which supplies the said reference voltage ($V_D$), connected on the one hand to the inverting input of the differential amplifier (A) through a divider bridge and on the other hand to the supply termianl of the voltage generator (REF). A control circuit (C) of the switching device is operated so as to receive at least the supply voltage in such a manner that the switching device (1) is closed when the supply voltage reaches a threshold for which both the voltage generator and the differential amplifier are in a nominal operating zone.

22 Claims, 2 Drawing Sheets

CIRCUIT INTENDED TO SUPPLY A REFERENCE VOLTAGE

BACKGROUND OF THE INVENTION

The invention relates to a circuit intended to supply a reference voltage comprising a voltage generator provided with a supply terminal and an output for supplying a voltage having a given nominal value, a differential amplifier provided with a non-inverting input coupled to the output of the voltage generator, an inverting input and an output, and a first follower stage provided with an input coupled to the output of the differential amplifier and an output for supplying the reference voltage, the differential amplifier being coupled between a first and second supply terminal for receiving a supply voltage and the output of the first follower stage being fed back to the inverting input by means of a divider bridge.

Such a circuit is known from the second edition of the electronical handbook "Analysis and Design of Analog Integrated Circuits" by Paul R. Gray and Robert G. Meyer (John Wiley and Sons—New York), FIG. 8.37, page 516. However, in the known circuit the voltage generator is liable to instabilities during application of a supply voltage. The invention has for its object to provide a circuit which avoids this disadvantage.

SUMMARY OF THE INVENTION

The basic idea of the invention consists in that the voltage of the voltage generator is transmitted to the input of the first follower stage only when the supply voltage is sufficient to ensure that the possible instability region is exceeded.

The circuit according to the invention is for this purpose characterized in that the output of the differential amplifier is coupled to the input of the first follower stage by means of a controlled switching device, the input of the first follower stage being further coupled to the first supply terminal by means of a resistor and the output of the first follower stage being coupled to the supply terminal of the voltage generator, and in that the circuit comprises a control circuit for controlling the switching device operated so as to receive at least the supply voltage in such a manner that the switching device is closed when the supply voltage attains a threshold for which both the voltage generator and the differential amplifier are in a nominal operating zone.

The voltage generator is fed by the reference voltage produced by the circuit and the reference voltage is, when the switching device has once been closed, 1/k timer higher than the voltage produced by the voltage generator, k being the division of the divider bridge. When the supply voltage has a low value, which is insufficient to ensure that the switching device is closed, the voltage at the output of the circuit, which also feeds the voltage generator, varies with the same slope as the supply votage, except for one constant. The curve of the output voltage as a function of the supply voltage is therefore no longer liable to the risk of instability.

It is particularly advantageous that the control circuit and the controlled switching device cooperate directly with the differential amplifier. This in fact permits simplifying the electronic circuit diagram.

For this purpose, the differential amplifier can comprise a first branch, whose input constitutes said non-inverting input, and a second branch, whose input constitutes said inverting input, the control circuit can be operated so as to inhibit passage of current in the second branch when the supply voltage is lower than said threshold, and the switching circuit can comprise a second follower stage, which is operated so as to conduct only when current flows through the second branch.

The first branch can comprise an emitter-collector path of a first transistor of a first type, whose base and collector are coupled to each other, for example by means of respectively an emitter and a base of a second transistor of the first type, whose collector is coupled to the second supply terminal, the collector of the first transistor being coupled to that of a third transistor of a second type opposite to the first type, whose emitter is coupled to the second supply terminal by means of a current source and whose base constitutes the non-inverting input of the differential amplifier. Such a branch has a structure that it derives current from a low level of the supply voltage.

The second branch can comprise an emitter-collector path of a fourth transistor of the first type, whose base is coupled to that of the first transistor, a collector of the fourth transistor being coupled to that of a fifth transistor of the second type, whose emitter is coupled to that of the third transistor and whose base constitutes the inverting input of the differential amplifier. Such a branch has a structure such that it derives current only from a significant comparatively high level of the first supply voltage.

The fourth transistor can have its emitter coupled to that of the first transistor.

The control circuit is advantageously common to the two branches. For this purpose, the control circuit can comprise a sixth transistor of the second type, whose collector is coupled to the first supply terminal, whose emitter is coupled to the emitters of the first and fourth transistors and whose base is coupled to a terminal of the first resistor, which is not coupled to the first supply terminal. The voltage at the base of the sixth transistor determines the threshold from which the differential amplifier produces an output signal.

The second follower stage can comprise a seventh transistor, whose base is coupled to the collector of the fifth transistor, whose collector is coupled to the second supply terminal and whose emitter is coupled to the input of the first follower stage, as the case may be through a forward-biased diode.

The value of the said threshold can be chosen with higher precision in that a further resistor is disposed between the aforesaid resistor and the input of the first follower stage.

The first follower stage advantageously comprises an eighth transistor having two emitters, whose base constitutes the input, whose collector is connected to the first supply terminal, whose first emitter is connected to an end of the bridge and whose second emitter constitutes the output of the first follower stage.

BRIEF DESCRIPTIVE OF THE DRAWINGS

The invention will be more clearly understood when reading the following description, given by way of non-limitative example, with reference to the drawings, in which:

FIG. 1 shows a regulator circuit of the series type according to the prior art mentioned above, FIG. 2 shows a circuit according to the invention, FIG. 3 shows a preferred embodiment of the invention, FIG. 4 shows a variation of FIG. 3, and FIG. 5 shows voltage curves as a function of the supply voltage according to FIG. 3 or 4.

DETAILED DESCRIPTION OF PREFERRED EMBODIMENTS OF THE INVENTION

Figure 1:
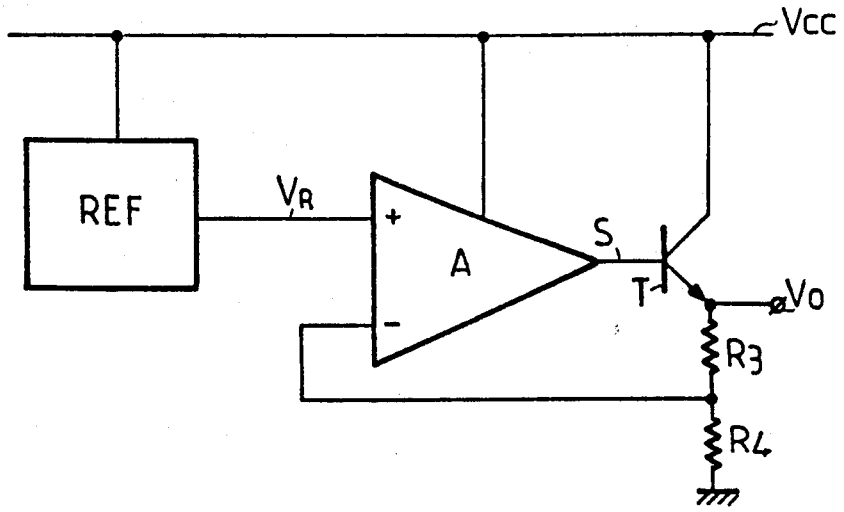
FIG. 1 PRIOR ART

According to FIG. 1, a voltage generator REF supplies a voltage $V_R$, which is applied to the non-inverting input of a differential amplifier A fed by a supply voltage $V_{cc}$. The output S of the amplifier 10 coupled to follower circuit T, whose output, which delivers a regulated reference voltage $V_0$, is fed back negatively to the inverting input of the amplifier A through a resistance divider bridge $R_3$, $R_4$. The voltage generator REF is fed by the supply voltage $V_{cc}$. During the application of a voltage, any instability of the voltage $V_R$ of the voltage generator REF has direct repercussions on the voltage $V_0$.

Figure 2:
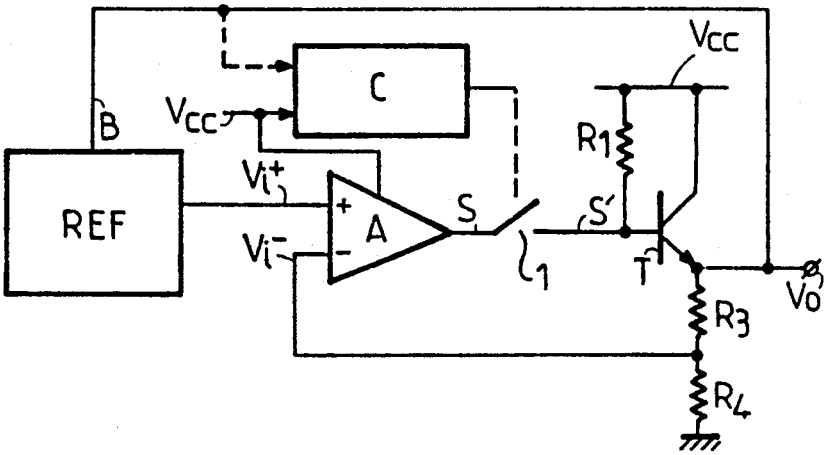

According to FIG. 2, the voltage generator REF delivers at the output a voltage $V_i+$, which is applied to the non-inverting input of the differential amplifier A fed from a supply voltage $V_{cc}$. The output S of the amplifier A is connected through a controlled switching device 1 to the input S' of the follower stage. A resistor $R_1$ is disposed between the input S' and the supply voltage source $V_{cc}$. The output of the follower stage delivers the regulated reference voltage $V_0$. This output is fed back to the inverting input of the amplifier A (signal $V_i-$) by means of a divider bridge comprising resistors $R_3$ and $R_4$. The signal $V_i-$ is present at the junction point (or centre tapping) of the divider bridge. The other end of the divider bridge is connected to a second supply voltage source (in this case the common mode terminal). The follower stage is represented as a transistor T, whose base is the point S', whose emitter delivers the signal $V_0$ and whose collector is connected to the supply voltage source $V_{cc}$. The signal $V_0$ is applied to the supply terminal of the voltage generator REF. A control circuit C, which receives the supply voltage $V_{cc}$ (and as the case may be the voltage $V_0$), is operated so as to close the switching device 1 when the supply voltage $V_{cc}$ exceeds a given threshold, for which the voltage $V_i+$ delivered by the voltage generator REF has exceeded the part of its characteristic in which instabilities can occur. Consequently, when a voltage is applied to the circuit, the supply voltage $V_{cc}$ starts from the value 0 and increases until it reaches its nominal value. When its value is lower than the given threshold, the switching circuit 1 is opened and the voltage $V_0$ evolves proportionally to the instantaneous value of the voltage $V_{cc}$ and independently of the voltage $V_i+$. In fact, the input S' of the follower stage is applied to the potential $V_{cc}$ through the resistor $R_1$. On the contrary, when the instantaneous value of the voltage $V_{cc}$ reaches the given threshold, the switching circuit 1 is closed and the voltage $V_0$ then has the value:

$$V_0 = \left(1 + \frac{R_3}{R_4}\right) V_i+$$

For a given value of $V_{cc}$, $V_i+$ reaches its nominal value $V_{REF}$.

Figure 3:
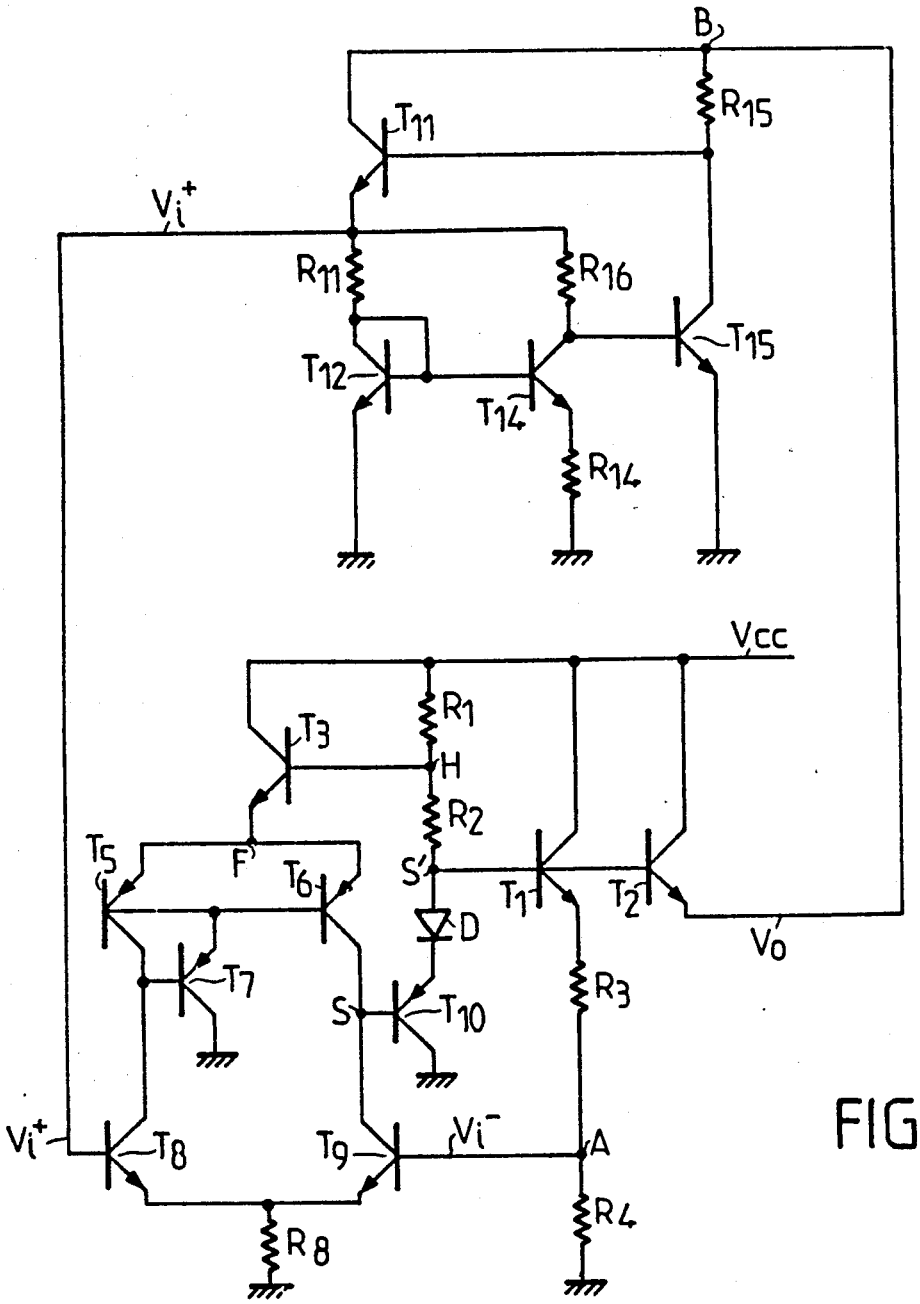

According to FIG. 3, a voltage generator (of the so-called "band gap" type) described in the aforementioned publication, page 295, comprises a transistor $T_{11}$ of the npn type, whose collector is connected to the point B mentioned above and which has a resistor $R_{15}$ serving as current source between its collector and its base. The emitter of the transistor $T_{11}$, which delivers the voltage $V_i+$, is connected to a diode (npn transistor $T_{12}$ connected as a diode by base-collector shortcircuit) through a resistor $R_{11}$. The emitter of the transistor $T_{12}$ is connected to the common mode terminal and its base is connected to that of a transistor $T_{14}$, whose emitter is connected to the common mode terminal through a resistor $R_{14}$ and whose collector is connected on the one hand to the emitter of the transistor $T_{11}$ through a resistor $R_{16}$ and on the other hand to the base of a npn transistor $T_{15}$, whose emitter is connected to the common mode terminal and whose collector is connected to the base of the transistor $T_{11}$.

The amplifier A comprises a first branch having a transistor $T_5$ of the pnp type, whose emitter is connected to a point F, whose base is connected to the emitter of a transistor $T_7$ of the pnp type, whose collector is connected to the common mode terminal and whose base is connected to the collector of the transistor $T_5$. The collector of the transistor $T_5$ is connected to that of a transistor $T_8$ of the npn type, whose base is coupled to the voltage $V_i+$ available at the emitter of the transistor $T_{11}$ and whose emitter is connected to the common mode terminal through a resistor $R_8$. The transistors $T_5$ and $T_7$ have two emitter-base junctions connected in series, which ensures that a current is susceptible to circulating in the first branch itself for a low potential value at the point F. The second branch has a pnp transistor $T_6$, whose emitter is connected to the point F, whose base is connected to that of the transistor $T_5$ and whose collector (point S) is connected to that of a npn transistor $T_9$, whose emitter is connected to the common mode terminal through the resistor $R_8$. The control circuit comprises a an npn transistor $T_3$, whose collector is connected to the supply voltage source $V_{cc}$, whose emitter is connected to the said point F and whose base is preferably connected to the centre tapping H of a divider bridge $R_1$, $R_2$, having two resistors $R_1$ and $R_2$ connected in series between the supply voltage source $V_{cc}$ and the point S', or directly to the point S', the resistor $R_2$ then being omitted. The switching circuit comprises a pnp transistor $T_{10}$, whose base is connected to the point S (output of the amplifier A), whose collector is connected to the common mode terminal and whose emitter is connected to the point S' through a forward-biased diode D.

The follower output stage comprises a transistor ($T_1$, $T_2$) having two emitters (or two transistors $T_1$ and $T_2$ arranged as an emitter follower), the emitter of $T_1$ being connected to the divider bridge ($R_3$, $R_4$) and that of $T_2$ delivering the voltage $V_o$ being connected to the point B. The presence of this double emitter (or of the two transistors) permits conventionally of obtaining a better decoupling with respect to the charge impedance.

When $V_{cc}$ has a value lower than the given threshold, the first branch of the amplifier is susceptible to being traversed by a current, but the second branch is not traversed by any current. The transistor $T_{10}$ is then cut off. The base of the transistors $T_1$ and $T_2$ is then applied to a potential very close to the instantaneous value of $V_{cc}$.

Then there is: $V_o=(V_{cc}-V_D)$ $$\text{and } V_i^- = (V_{cc} - V_D)\frac{R_4}{R_3 + R_4}$$

with $V_D$=base-emitter voltage of a transistor (about 0.7 V).

When $V_{cc}$ reaches the given threshold, the second branch of the amplifier is traversed by a current sufficient to ensure that the transistor $T_{10}$ is in the conducting state. The amplifier is in its operating region and there is:

$$V_{S'} = V_o + V_D = V_i^-\left(1 + \frac{R_3}{R_4}\right) + V_D$$

$V_{S'}$ designating the voltage at the point S'.

Consider $V_i^+ \simeq V_{REF}$, that is to say that for the calculation it is considered that the voltage threshold corresponds practically to the correct operating threshold of the voltage generator. It follows that:

$$V_H = \frac{R_2}{R_1 + R_2} V_{cc} + \frac{R_1}{R_1 + R_2}\left[\left(1 + \frac{R_3}{R_4}\right)V_{REF} + V_D\right]$$

For the amplifier described, a correct operation imposes that $V_H$ is at least equal to 5 $V_D$ (in fact it is necessary that $V_H$ is substantially higher than that value). Then there is:

$$\frac{R_2 V_{cco}}{R_1 + R_2} \simeq 5V_D - \frac{R_1}{R_1 + R_2}\left[\left(1 + \frac{R_3}{R_4}\right)V_{REF} + V_D\right]$$

$$V_{cco} \simeq 5V_D + \frac{R_1}{R_2}\left[4V_D - \left(1 + \frac{R_3}{R_4}\right)V_{REF}\right]$$

The ratio $R_1/R_2$ therefore permits of determining the threshold $V_{cc0}$ of $V_{cc}$ from which the switching circuit is closed. If the resistor $R_2$ is omitted, the points H and S' are confounded and $$V_H = V_{S'} = \left(1 + \frac{R_3}{R_4}\right)V_{REF} + V_D$$

and the resistor $R_1$ no longer influences the determination of the threshold. It is then necessary that:

$$V_{cco} > \left(1 + \frac{R_3}{R_4}\right)V_{REF} + V_D > 5V_D$$

Figure 4:
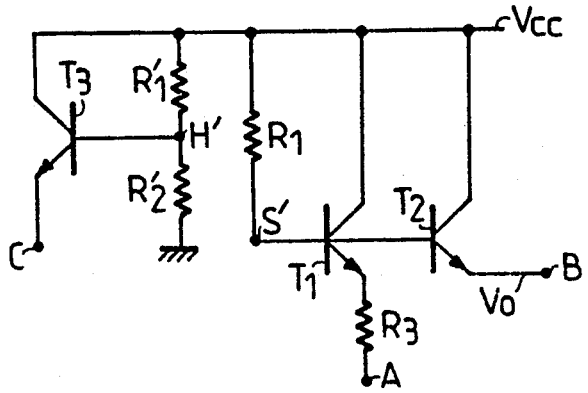

According to FIG. 4, the base of the transistor $T_3$ is connected to the centre tapping H' of a divider bridge $R'_1$ and $R'_2$ disposed between the voltage source $V_{cc}$ and the common mode terminal. The base of the transistor $T_1$ is connected to the voltage source $V_{cc}$ through the resistor $R_1$. The emitter of the transistor $T_3$ is connected to the point C, that of the transistor $T_1$ is connected to the point A through the resistor $R_3$ and that of the transistor $T_2$ is connected to the point B. The remainder of the circuit is as in FIG. 3.

There is:

$$V_{H'} = \frac{R_2'}{R_1' + R_2'} V_{cc}.$$

The threshold condition then is:

$$V_{H'} > 5V_D.$$

Let it be assumed that $$V_{cc0} \simeq 5V_D\left(1 + \frac{R_1'}{R_2'}\right).$$

The ratio $R'_1/R_2$ determines the threshold $V_{cc0}$ of $V_{cc}$ from which the switching circuit is closed.

Figure 5:
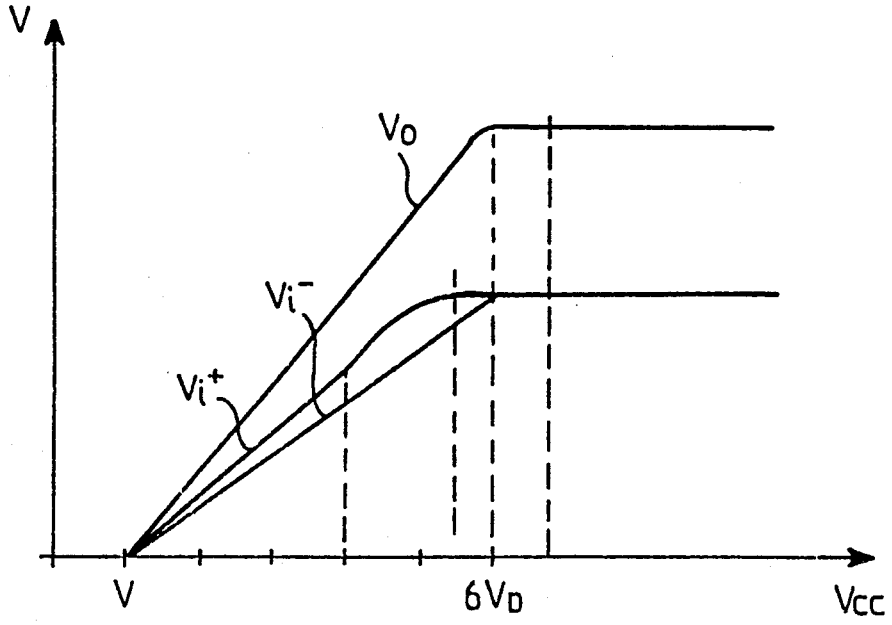

According to FIG. 5, the voltages $V_i^+$, $V_i^-$ and $V_0$ increase as soon as $V_{cc}$ reaches $V_D$ (0.7 V), the regulation being obtained from 6 $V_D$ (about 4.2 V).

We claims:

1. A circuit intended to supply a reference voltage comprising a voltage generator provided with a supply terminal and an output for supplying a voltage having a given nominal value, a differential amplifier provided with a non-inverting input coupled to the output of the voltage generator, an inverting input and an output, and a first follower stage provided with an input coupled to the output of the differential amplifier and an output for supplying the reference voltage, the differential amplifier being coupled between a first and second supply terminal for receiving a supply voltage and the output of the first follower stage being fed back to the inverting input by means of a divider bridge, characterized in that the output of the differential amplifier is coupled to the input of the first follower stage by means of a controlled switching device, the input of the first follower stage being further coupled to the first supply terminal by means of a resistor and the output of the first follower stage being coupled to the supply terminal of the voltage generator, and in that the circuit comprises a control circuit for controlling the switching device operated so as to receive at least the supply voltage in such a manner that the switching device is closed when the supply voltage attains a threshold for which both the voltage generator and the differential amplifier are in a nominal operating zone.

2. A circuit as claimed in claim 1, wherein the differential amplifier comprises a first branch, whose input constitutes said non-inverting input, and a second branch, whose input constitutes said inverting input, in that the control circuit is operated so as to inhibit passage of current in the second branch when the supply voltage is lower than said threshold, and in that the switching circuit comprises a second follower stage, which is operated so as to conduct only when current flows through the second branch.

3. A circuit as claimed in claim 2, wherein the first branch comprises an emitter-collector path of a first transistor of a first type, whose base and collector are coupled to each other, by means of respectively an emitter and a base of a second transistor of the first type, whose collector is coupled to the second supply terminal, the collector of the first transistor being coupled to that of a third transistor of a second opposite to the first type, whose emitter is coupled to the second supply terminal by means of a current source and whose base constitutes the non-inverting input of the differential amplifier.

4. A circuit as claimed in claim 3, wherein the second branch comprises an emitter-collector path of a fourth transistor of the first type, whose base is coupled to that of the first transistor, a collector of the fourth transistor being coupled to that of a fifth transistor of the second type, whose emitter is coupled to that of the third transistor and whose base constitutes the inverting input of the differential amplifier.

5. A circuit as claimed in claim 4, wherein the emitter of the fourth transistor is coupled to that of the first transistor.

6. A circuit as claimed in claim 5, wherein the control circuit comprises a sixth transistor of the second type, whose collector is coupled to the first supply terminal, whose emitter is coupled to the emitters of the first and fourth transistors and whose base is coupled to a terminal of the first resistor, which is not coupled to the first supply terminal.

7. A circuit as claimed in claim 6, wherein the second follower stage comprises a seventh transistor, whose base is coupled to the collector of the fifth transistor, whose collector is coupled to the second supply terminal and whose emitter is coupled to the input of the first follower stage.

8. A circuit as claimed in claim 7, wherein the emitter of the seventh transistor is coupled to the input of the first follower stage by means of a forward-biased diode.

9. A circuit as claimed in claim 7, wherein a further resistor is disposed between the aforesaid resistor and the input of the first follower stage.

10. A circuit as claimed in claim 7, wherein the first follower stage comprises an eighth transistor having two emitters, whose base constitutes the input, whose collector is connected to the first supply terminal, whose first emitter is connected to an end of the divider bridge and whose second emitter constitutes the output of the first follower stage.

11. A circuit as claimed in 7, wherein the divider bridge comprises a third and a fourth resistor.

12. A circuit as claimed in claim 8 wherein a further resistor is disposed between the aforesaid resistor and the input of the first follower stage.

13. A circuit as claimed in claim 8, wherein the first follower stage comprises an eighth transistor having two emitters, whose base constitutes the input, whose collector is connected to the first supply terminal, whose first emitter is connected to an end of the divider bridge and whose second emitter constitutes the output of the first follower stage.

14. A circuit as claimed in claim 9, wherein the first follower stage comprises an eighth transistor having two emitters, whose base constitutes the input, whose collector is connected to the first supply terminal, whose first emitter is connected to an end of the divider bridge and whose second emitter constitutes the output of the first follower stage.

15. A circuit as claimed in claim 12, wherein the first follower stage comprises an eighth transistor having two emitters, whose base constitutes the input, whose collector is connected to the first supply terminal, whose first emitter is connected to an end of the divider bridge and whose second emitter constitutes the output of the first follower stage.

16. A circuit as claimed in claim 8, wherein the divider bridge comprises a third and a fourth resistor.

17. A circuit as claimed in claim 9, wherein the divider bridge comprises a third and a fourth resistor.

18. A circuit as claimed in claim 10, wherein the divider bridge comprises a third and a fourth resistor.

19. A circuit as claimed in claim 12, wherein the divider bridge comprises a third and a fourth resistor.

20. A circuit as claimed in claim 13, wherein the divider bridge comprises a third and a fourth resistor.

21. A circuit as claimed in claim 14, wherein the divider bridge comprises a third and a fourth resistor.

22. A circuit as claimed in claim 15, wherein the divider bridge comprises a third and a fourth resistor.

* * * * *